US005403260A

United States Patent [19]

Hensley

[11] Patent Number: 5,403,260

[45] Date of Patent: Apr. 4, 1995

[54] AUTOMATIC FREQUENCY CONTROLLED MOTOR BACKDRIVE

[75] Inventor: Gary Hensley, Dayton, Tex.

[73] Assignee: Hutchinson-Hayes International, Houston, Tex.

[21] Appl. No.: 72,174

[22] Filed: Jun. 4, 1993

[51] Int. Cl.[6] ..... B04B 9/04

[52] U.S. Cl. ..... 494/53; 494/8

[58] Field of Search ..... 494/37, 51–55, 494/84, 7, 8

[56] References Cited

U.S. PATENT DOCUMENTS

| | | | |
|---|---|---|---|
| 3,734,399 | 5/1973 | Oas | 494/84 |
| 4,141,488 | 2/1979 | Gense | 494/53 |
| 4,240,578 | 12/1986 | Jackson | 494/84 |
| 4,298,162 | 11/1981 | Hohne | 494/53 |
| 4,299,353 | 11/1981 | Bruning | 494/53 |
| 4,369,915 | 1/1983 | Oberg | 494/53 |
| 5,203,762 | 4/1993 | Cooperstein | 494/53 |

*Primary Examiner*—David A. Scherbel
*Assistant Examiner*—Terrence R. Till
*Attorney, Agent, or Firm*—Gunn & Kuffner

[57] ABSTRACT

In a horizontal centrifuge, a bowl rotates in the same direction as a screw internally of the bowl. The bowl and screw connect to a three input gear box which rotates the bowl and screw at a small differential, or the scrolling rate. A separate motor running at a variable rate connects to the third gear box input and thereby reduces the scrolling rate. A feedback loop connects to the motor to vary the motor speed so that the scrolling rate is varied. A maindrive motor rotates the bowl which then couples through the gear box to rotate the screw and thereby furnish the power to rotate the bowl and screw.

26 Claims, 4 Drawing Sheets

AUTOMATIC FREQUENCY CONTROLLED MOTOR BACKDRIVE

BACKGROUND OF THE DISCLOSURE

The present disclosure is directed to a motor driven, high velocity centrifuge, and more particularly to a centrifuge which incorporates a horizontal rotating drum which is capable of separating particulate material or solids from a liquid. The apparatus finds use in separating oil and water mixed in an emulsion or particles in a liquid such as liquids formed in vegetable and meat processing in food plants, slaughter houses and the like.

The apparatus is directed to a horizontal shaft centrifuge having a screw with flights on the shaft exterior and arranged on the interior of a rotating bowl. The preferred form is stainless steel which resist the corrosion encountered in many types of fluids. At one end, a-slurry is introduced. The slurry is formed of liquid and solid particles, or alternately is formed of immiscible liquids which have differing densities. A relatively large motor, typically 50, perhaps 100 or more horsepower in size, is used to rotate a bowl which drives a screw conveyor aligned axially, in the bowl, where the bowl rotation is imparted to a planetary gearbox connected from the bowl to the screw conveyor. One end of the screw connects to the gear to transfers rotative movement from the bowl to the screw. Both the bowl and the screw rotate together and rotate at almost the same speed. They are not synchronized because there is a difference in speed. As an example, assume for purposes of discussion that the bowl is rotated at 4000 rpm. Assume further that the screw conveyor rotates almost at that speed, this difference being accomplished by the gear box. The difference in the two speeds relates to the recovery of the separated solids. Very briefly, this scrolling rate, represented by the difference in the two speeds (known as the scrolling rate), is preferably reduced to obtain a longer residence time so that the solids are more readily recovered from the centrifuge. Resident time enables settling of the smallest of solid particles as they are collected and as they migrate towards the solid outlet of the bowl. It is desirable on the one hand to extend the residence time to recover more of the solids. On the other hand, it is desirable to reduce the residence so that the throughput of the system is increased. In seeking a balance in the residence time, adjustments must be made periodically to the scroll rate.

In an example, in assuming 4000 rpm for the bowl, if the scrolling rate is 6 rpm, this means that the screw has to rotate at 3994 rpm. A transmission interconnects the rotating members so that this small differential in speed is obtained. Nevertheless, the present apparatus provides a scrolling control mechanism useful with a gear box and back drive in a centrifuge which enables control of the scrolling rate in the range of 50 rpm and less. Scrolling rate is adjusted as will be detailed.

Presently, there is a gear box connected between the bowl of a centrifuge and the screw on the interior. The purpose normally is to use the gear box so that a fixed scrolling rate is achieved between the rotating screw and the surrounding drum. In this instance, the present invention incorporates a separate motor. This motor is provided with a frequency controlled, constant torque drive system. More particularly, torque output is measured. As the torque requirements change, a change in frequency is implemented. The change in frequency coupled with a drive amplifier enables a motor to be driven in synchronous fashion with the frequency source. This causes the equipment to operate at a controllable scrolling rate. The variable frequency drive motor is input through the gear box so that the gear box changes the transfer of power coupled from the main drive motor through the bowl. This will change the relative rotational speed of the bowl and screw, thereby changing the scrolling rate.

The present apparatus is summarized as a system involving a separate motor connected with the gear box for a horizontal centrifuge. More specifically, the centrifuge includes a central screw mounted on a shaft with a bowl rotated by a large motor. The large motor provides adequate power for rotation of the bowl and additionally couples rotative torque through the gear box so that rotation is imparted to the screw conveyor which is mounted for rotation in the bowl. A mix or slurry is introduced at a central location along the screw and the mixture of solids and liquids are centrifugally forced against the bowl. Because of the scrolling interaction of the flights on the screw with the surrounding bowl, scrolling a separating force is imparted to the particles making up the slurry. As a result of the interaction of the screw flights with the bowl, the solid particles are conveyed toward the conical end of the bowl and the liquid is displaced toward the opposite end of the bowl. This separation of liquid from solids results from differences in particle density and also because there is a relative difference in velocity between the screw and the bowl accomplished through a connective gear box. Additional slurry is added at a controlled rate to provide a flow from the two bowl outputs, one being the separated solids and the other being the liquids. The present invention, fortunately, provides an additional power input to the gear box. In conjunction with a frequency meter, variable frequency oscillator, power amplifier, and frequency responsive motor, it is possible to change the backdrive velocity so that the gear box makes the screw and bowl rotate at almost the same speed resulting in nearly synchronous rotation. The scrolling rate is controlled dependent on torque. This enables the scroll rate to be controllably determined, thereby obtaining the desired rate of rotation and thereby obtaining increased or decreased residence time.

SUMMARY OF THE INVENTION

In the context of a horizontal rotating bowl, a slurry is introduced at the central portions of the bowl and is separated by the interaction of the bowl and a rotating screw with flights. The screw flights are scrolled relative to the bowl. This is accomplished under control via a connective gear box having a planetary drive enabling the gear box to drive both the bowl and screw but at a difference known as the scrolling rate. The gear box features an input from a motor driven at a variable speed to enable scroll rate adjustment. This also involves a torque meter measuring load cooperating with a variable frequency drive. This enables at a variable scroll rate.

BRIEF DESCRIPTION OF THE DRAWINGS

So that the manner in which the above recited features, advantages and objects of the present invention are attained and can be understood in detail, a more particular description of the invention, briefly summarized above, may be had by reference to the embodiments thereof which are illustrated in the appended drawings.

It is to be noted, however, that the appended drawings illustrate only typical embodiments of this invention and are therefore not to be considered limiting of its scope, for the invention may admit to other embodiments.

DESCRIPTION OF THE PREFERRED EMBODIMENT

Figure 1:
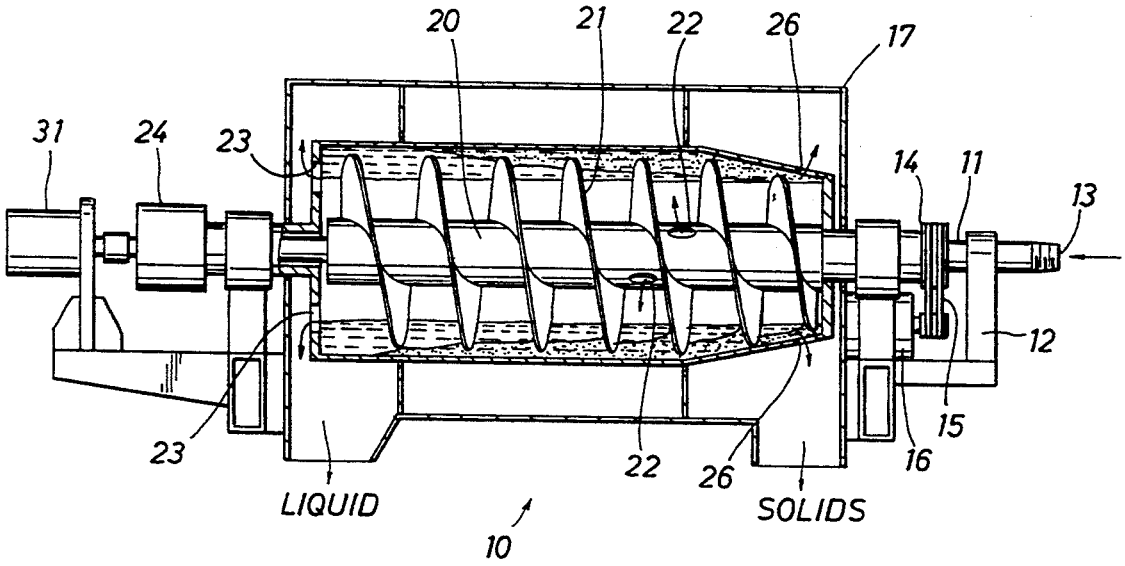
FIG. 1 is a sectional view through a horizontal centrifuge in accordance of the teachings of the present disclosure which is mounted on a skid and which shows in sectional view a bowl surrounding the flights of a screw on the interior for separation of liquid and solids.

Attention is now directed to FIG. 1 of the drawings where the numeral 10 refers generally to the improved centrifuge of the present invention. It is typically mounted on a skid (omitted for sake of clarity) and is typically installed permanently by fastening a support frame work under the structure to anchor the centrifuge on the skid. Briefly, the structure incorporates a horizontal hollow shaft 11 which serves a dual purpose. It is a fluid inlet shaft which extends through a suitable set of support at an alignment block 12. In this regard, it has a fluid inlet 13. It is hollow, thereby enabling a slurry to be introduced from one end, and that slurry is delivered for separation. The shaft 11 is centered inside of one or more pulleys 14 which cooperate with a belt drive 15 which in turn connects with the drive shaft of a large drive motor 16. The drive motor is normally a 50 to 100 horsepower motor. Typically, it is a three-phase induction motor capable of providing a speed of 1750 rpm and is driven by three-phase power furnished at 60 hertz. Typically, it operates at 234 or 460 VAC. The motor 16 is mounted on the far side of the support frame or cabinet 17. This frame or cabinet completely encloses the structure to confine the separated discharge. Because there are rotating parts in the structure, it is also important for the sake of safety to include such a cabinet.

Going now to the interior, the numeral 20 identifies a rotating screw which is provided with a helical flight 21. The helical screw is aligned with the shaft 13. Moreover, power is input at the right as shown in FIG. 1 of the drawings, and is transferred to the opposite end of the equipment to a gear box 24. The gear box will be described in some detail hereinafter. The gear box is operatively connected with the rotating bowl 25. The bowl is rotated at almost the same velocity and in the same direction as the screw 20. The difference in the velocity between the two is defined as the scroll rate, and one purpose of the present system is to control the scroll rate. The significance of this will be explained in detail later.

Going now to additional details of FIG. 1, it will be observed that a slurry is introduced at the hollow shaft 13. There are openings which enable communication from the liquid input 13 to the interior of the bowl. One representative opening is shown at 22. The slurry is introduced into the bowl and is forced to the exterior where it lines the wall of the bowl. The bowl 25 is provided with a set of openings 23 which drain the bowl of liquid. Observe that the liquid is displaced by added liquid which flows to the left in FIG. 1. liquid is discharged at the left end through the ports 23. By contrast, there are several ports 26 at the right end which discharge collectively solids. As will be understood, two or three of the ports 23 are incorporated. Likewise, two or three 26 are incorporated. The interior of the housing or cabinet 17 includes multiple dividers 27 so that there is a liquid outlet from the cabinet, the liquid outlet being identified at 28 and the solid outlet is 29. Ideally, the discharged liquid is completely clarified while the discharged solids are substantially dry.

The theory of operation is believed to be well known insofar as the centrifuge is concerned. The mixture or slurry of materials which are introduced is separated, and the water is displaced to the left and the solids are conveyed to the right. The solids are forced to the right by the relative rotation of the flights of the screw. Liquid is added in the fashion of adding liquid to a container which overflows. In this instance, the liquid container overflows on adding liquid to cause liquid to flow from the openings 23 at the left hand end. In this form of the equipment, the liquid level is raised as more is added but that has the form of filling the outer reaches of the spinning bowl until the liquid reaches the openings 23 so that the liquid escapes at the left end of the bowl. Newly added liquid does not immediately appear at the openings 23; rather, it must flow through the helical path defined by the screw flights so that the overflowing liquid is substantially clarified and the discharge is centrifugally separated into the liquid and solid fractions.

Figure 2:
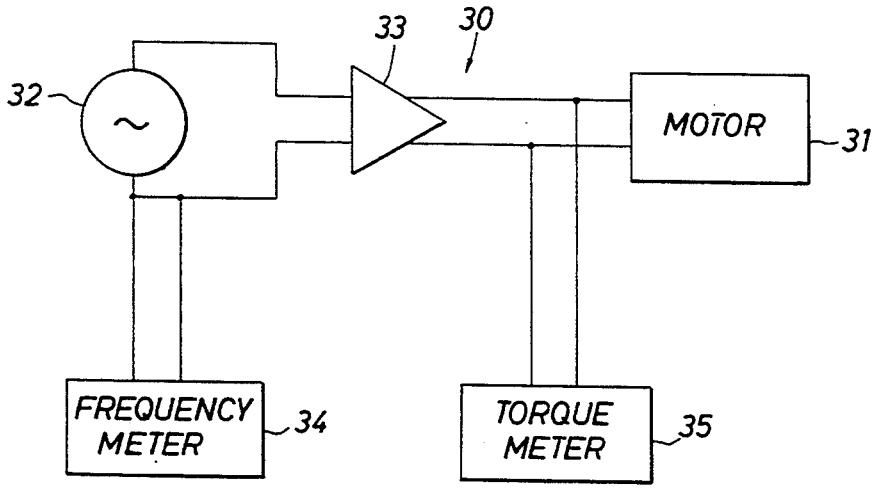
FIG. 2 is a schematic block diagram of a control system which is useful for controlling the speed of a motor connected to a gear box to control the scroll rate of the present system.

The scroll rate in the present system is determined by the control system shown in FIG. 2 of the drawings and indicated generally by the numeral 30. The scroll rate involves the use of a motor 31. The motor 31 is shown in FIG. 1 of the drawings where it provides a controlled frequency input to enhance the rate of rotation input to the gear box 24. The motor 31 is driven by a variable frequency oscillator or VFO 32. That is connected to a drive amplifier 33. This provides an adequate voltage and current for operation of the motor 31. It is not uncommon for the motor 16 to measure 50 to 100 horsepower. The motor 31 typically is in the range of 4 to 12 horsepower. A typical motor is about 5 horsepower. The operative frequency of the VFO 32 is measured by a frequency meter 34. A torque meter 35 is also included. The VFO can be adjusted to any frequency. A typical frequency range is perhaps 8 to 120 hertz. Preferably, the motor 31 is a synchronous motor which therefore suggests that its speed is controlled by adjustment of the VFO 32. The frequency is adjusted while observing the output at the torque meter 35. As will be understood, there is a tendency for the system to increase the torque required with increases in the weight in the material being rotated in the bowl. In the event that the torque becomes excessive and an excessive current is required for operation of the motor, it is desirable to incorporate a cutoff valve (not shown) in the supply line that delivers the slurry to the inlet 13 in FIG. 1. When the torque becomes excessive, the interruption of slurry delivered to the equipment immediately reduces the volume of material in the drum and thereby reduces the power needed to rotate the drum.

Figure 3A:
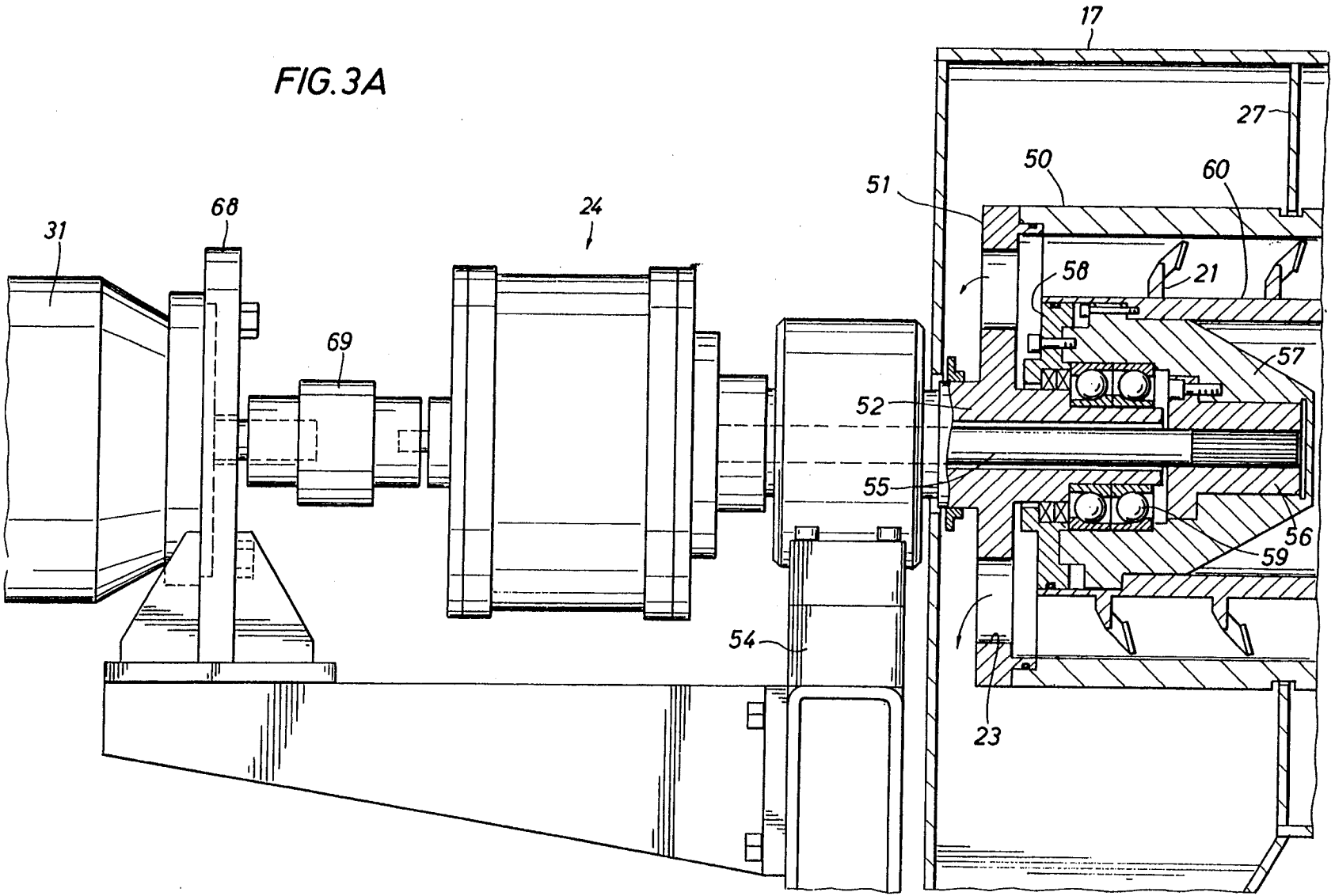
FIG. 3 which is formed of panels 3A and 3B is an elongate sectional view through the bowl and internal screw further showing details of construction of the mounting shafts at the respective ends of the screw and bowl.
Figure 3B:
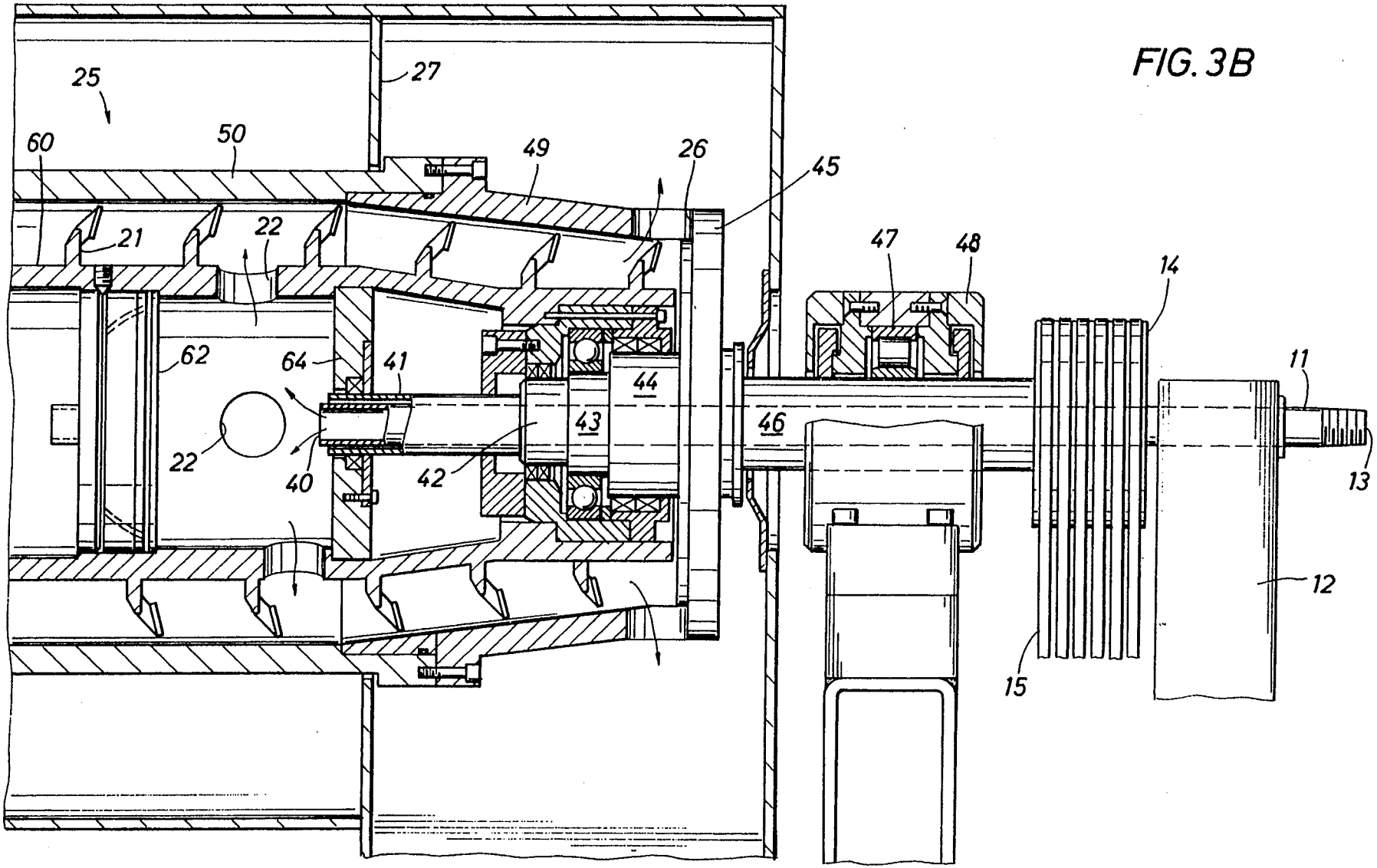

Attention is now directed to the right hand end of FIG. 3B. The description will proceed from that portion of the equipment to the left side of FIG. 3B and then ultimately to the left side of FIG. 3A. Beginning, therefore, in FIG. 3B, the shaft 11 is shown at the right end supported by suitable support 12 as mentioned. A suitable feed line is connected at the threaded input 13. The shaft 11 does not rotate. It is centrally located so that an outlet end 40 introduces liquid on the interior of the screw. More particularly, this hollow shaft is centered with or concentric on the interior of a shaft 41 which is connected through the equipment and provided with enlarged steps at 42 and 43. The step 44 is larger yet. The step 44 is adjacent to and connects with a hub 45 which is the end of the drum or bowl. In turn, the hub connects with a hollow shaft 46 and terminates at the pulleys 14 previously mentioned. They impart rotation to the bowl from the motor through the belt drive as previously mentioned. This rotating equipment is supported by a suitable bearing assembly 47 which is supported in a bearing support housing 48. The power applied from the drive through the belts 14 is imparted through the hollow shaft 46. The shaft 46 surrounds the stationary hollow shaft 11. As required, suitable bearing and seal assemblies are on the exterior of the shaft 40 and on the interior at the steps 42, 43, and 44.

Figure 4:
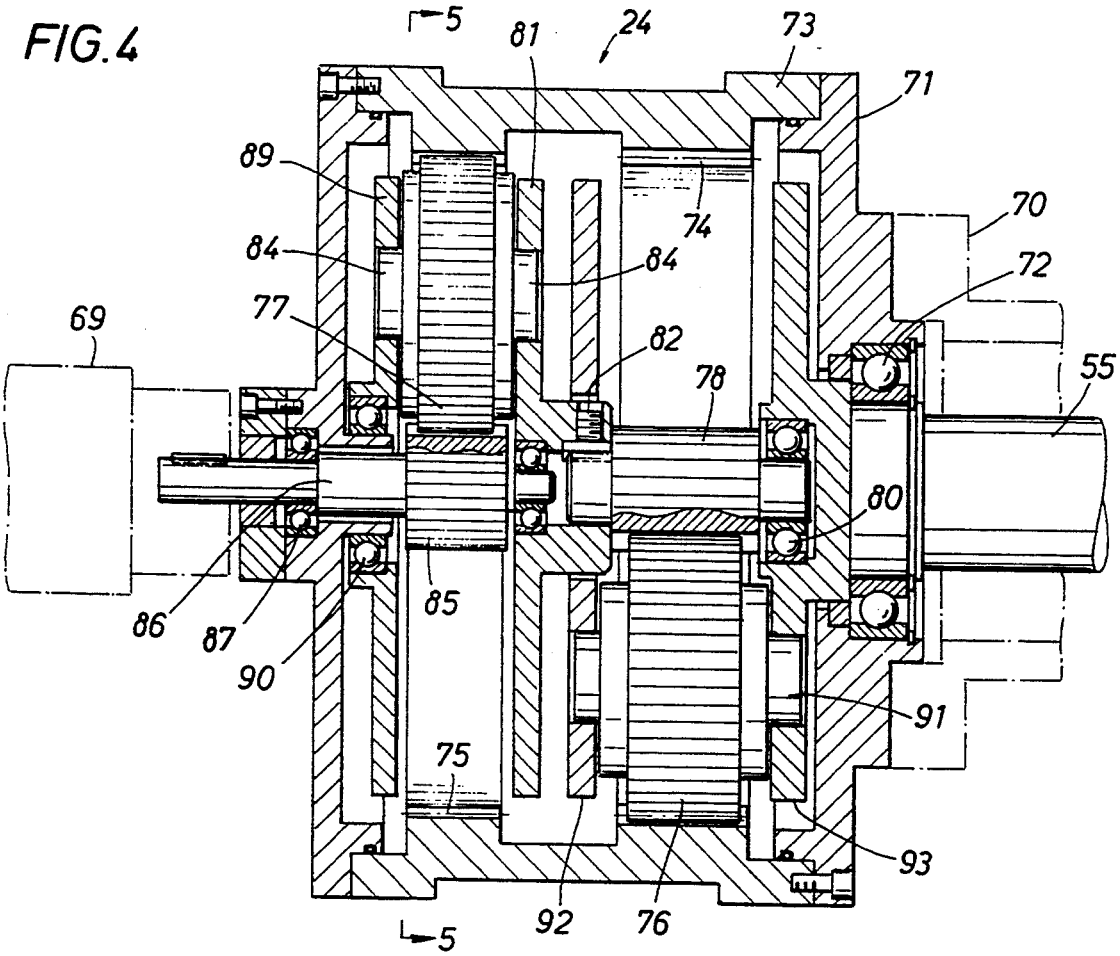
FIG. 4 is a sectional view along a diameter through a cylindrical gear box showing construction of the gear box.
Figure 5:
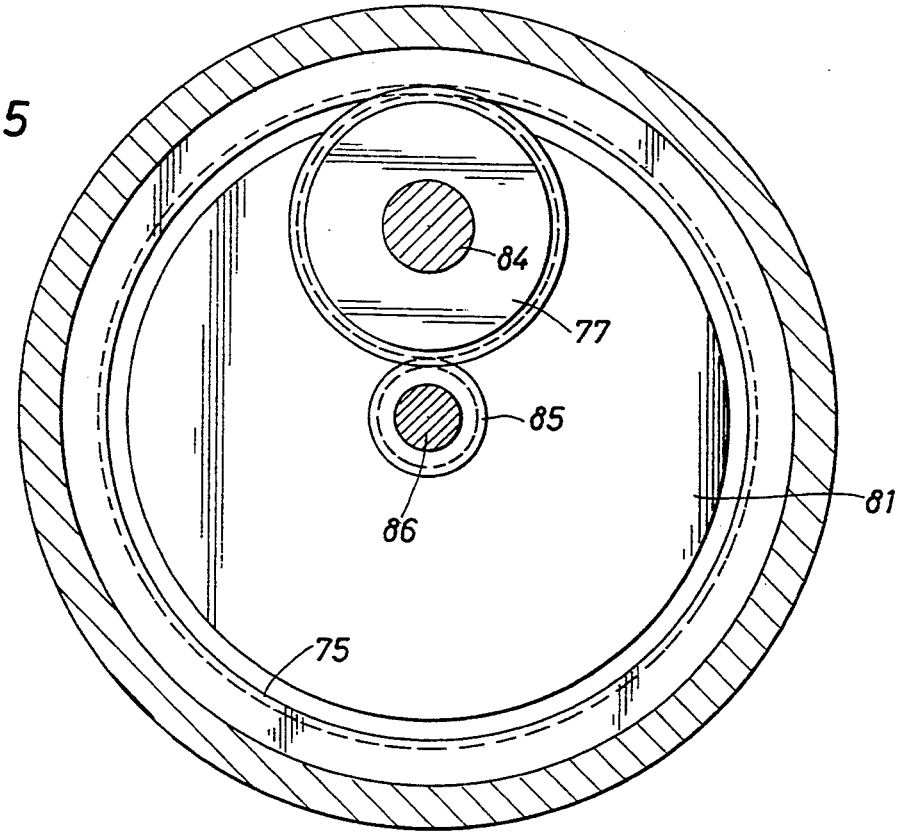
FIG. 5 is a view along the line 5—5 of FIG. 4 showing details of construction of a planetary gear system.

As described so far, the drive motor imparts rotation to the external shaft 46 which connects with the hub 45 and the end of the bowl. The bowl 25 is therefore driven directly therefore by the motor and rotates at that speed. The bowl shown in FIG. 3B is comprised of a tapered transition piece 49 which connects by suitable flanges to the external drum 50 which makes up the bowl. More particularly, the centrifuge which is defined internally of the drum 50 extends to the far left hand end, note the hub 51 at the end of the bowl shown in FIG. 3A. This hub is rotated with the drum 50. As shown in FIG. 3A, rotation of the hub 51 is imparted to a cylindrical sleeve 52 and that motion is coupled to the gear box 24. A suitable bearing assembly and appropriate pillow block are included at 54, and preferably have the same construction as the bearing 47 and the supporting pillow block 48 at the far right hand end of the equipment just mentioned with regard to FIG. 3B. In any case, the sleeve 52 imparts rotation to the gear box 24. That will be discussed separately when the operation of the gear box at FIG. 4 and FIG. 5 is detailed. Suffice to say, rotation is delivered to the gear box 24 through the rotating bowl, and rotation is then transferred from the gear box 24 to an output shaft 55. The shaft 55 is joined by means of splines to a surrounding hub 56, and the hub in turn is anchored by bolts to a cone shaped assembly 57. The cone 57 is in turn bolted to an end plate 58, and the end plate 58 captures on the interior a bearing assembly 59. The bearing assembly 59 permits relative rotation between the bowl and the screw as will be described. The bearing assembly 59 is on the interior of the cone shaped assembly 57. They are located on the interior of a cylindrical hollow shaft 60 which makes up the body of the screw 20.

The screw supports the flights 21. They extend along the bowl and more specifically inside the drum 50 which is part of the bowl. Keeping in mind that they rotate in the same direction but at slightly different velocities, there is relatively motion which is accommodated by the bearing assembly 59. More specifically, the gear box 24 provides the rotation to the shaft 55 which rotates the screw at the desired velocity. Since the bowl is rotated at one velocity and is directly driven by the motor, the gear box provides a variable output rotation rate which in conjunction with the other equipment assures proper operation of the system. More specifically, the scrolling rate is achieved between these two components, namely the screw 20 and the bowl 25. As viewed further in FIG. 3A and 3B jointly, the screw which is defined by the cylindrical column 60 is axially hollow. The flights 21 which are affixed to the exterior define the helical thread which advances the solids, thereby achieving separation. Moreover, the hollow shaft 60 is rotatable as a unit, being supported at the extreme ends by the hubs 45 and 51. It is hollow to reduce weight and is provided with appropriate internal walls such as the transverse wall 62 shown in FIG. 3B. In addition to that, a transverse wall 64 isolates the introduced slurry to the left of that wall as shown in FIG. 3B.

The pathway of the slurry is defined by the fixed hollow shaft 11 which has the open end 40 to introduce the slurry into the centrifuge. More specifically, the open end 40 is on the interior of the screw. Slurry flows to the exterior through the openings 22 previously mentioned and engages the flights. As mentioned, the solids which are heavier are forced towards the right hand end of the equipment in FIG. 3B and are delivered out of the bowl 25 through the openings 26. The openings 26 discharge the solids which are centrifugally thrown radially outwardly to collect within the fixed surrounding housing and are exhausted downwardly. As will be understood, liquid is carried by the cooperative rotating bowl 25 and the screw flights 21, the liquid is displaced to the left so that it flows through the openings 23 which are formed in the hub 51 at the opposite end of the screw. This point of discharge enables the liquid to be thrown centrifugally radially outward. It is, however, captured within the confines of the surrounding housing and flows downwardly. It is gathered at the liquid outlet.

As further shown in FIG. 3A, the motor 31 is supported by a mounting plate 68. A coupling 69 is connected between the motor 31 and the gear box 24. This provides a power input to the gear box at a controllable speed which serves a function that will be described. That can be understood best by referring now to FIG. 4 of the drawings.

In FIG. 4, the gear box 24 has a fixed external protective shroud which has been omitted for sake of clarity. The components shown in FIG. 4 are all permitted to rotate. Perhaps this will be more readily understood by beginning with the rotative input which is delivered at the right side of FIG. 4. Note that the coupling 70 imparts rotation from the bowl 25 through the pillow block 54 (See FIG. 3A) into the gear box 24. The rotating part 70 is thus driven by the bowl and rotates with it because the two are connected. This imparts rotation to the end plate 71 of the gear box. That plate is supported on a bearing assembly 72 which enables rotation at different velocities. The plate 71 is sealed to and joined with a surrounding cylindrical housing 73. The housing 73 has a set of teeth 74 formed on the interior. There is a second set of teeth formed at 75. They are both located on the interior. They are similar in construction but the teeth differ in number; this is accomplished by forming teeth having a different pitch. More will be noted concerning this hereinafter. The rotation imparted to the shell 73 is transferred to the shell by the teeth 74 to a planetary gear 76. The gear 76 has teeth which mesh with the teeth 74. In like fashion, the teeth 75 mesh with a gear 77 which is a planetary gear also. The sectional cut of FIG. 5 shows only one planetary gear. To balance the structure, preferably two or three are located on the interior of each of the internal gears 74 and 75. Rotation is therefore transferred from the input coupling 70 through the plate 71 and to the surrounding shell 73. In turn, rotation is transferred through the teeth 74 to the planetary gear 76. That causes rotation of the gear 78 which is formed on the exterior of a short shaft 79. The shaft 79 is mounted in suitable bearings 80 for rotation. The shaft 79 rotates with or in unison with an attached hub 81. The hub 81 is joined to the shaft 79 by means of a key in a key way locked in place by a threaded lock screw 82. The key secures the hub 81 to rotate with the shaft 79 which in turn is driven by the gear 78. The hub 81 supports at a sized opening the shaft 84 which shaft supports the gear 77. The gear 77 is rotated by virtue of the mounting of the shafts on the gear. In turn, the gear 77 meshes with and rotates the gear 85. This gear imparts rotation to the shaft 86. The shaft 86 is supported in appropriate bearings at 87 and the shaft 86 extends further to the left in FIG. 4 so that it engages (by means of a key way connection) the coupling 69 previously mentioned. The shaft 84 through the gear 77 is supported at both ends at rotating hubs 81 and 89. These two hubs rotate synchronous with the center axis of the gear 77. That is aligned and supported by the bearing assembly 90 located at the center of the hub 89. This permits rotation around the shaft 86.

Rotation which is imparted to the gear 76 causes the gear 76 to move as a planet around the gear 78 hence, the reference to sun and planetary gears. The gear 78 in conjunction with the planetary gears (one being illustrated but two or three being used in the preferred form) causes the shaft 79 to rotate and causes absolute rotation of the shaft 91 which supports the gear 76. The shaft 91 is supported in a pair of hubs 92 and 93. The hubs 92 and 93 are forced to rotate. When they rotate, they couple rotation through the hub 93 to the output shaft 55. This rotates in the same direction as does the external housing 70 thereabout, and the two modes of rotation, while being in the same direction, nevertheless differ and they are imparted to the bowl and screw.

Consider now the results of driving the motor 31 which provides rotation through the coupling 69 into the gear box 24 better shown in FIG. 4 of the drawings. There, rotation is input at 70 and couples through the two sets of planetary gears shown in the drawings to rotate the shaft 55. Dependent on the ratio and the gear box, the output is varied. Consider as an example a bowl which rotates in a particular direction at 3000 rpm. Assume further that the gear box has a ratio of 53:1. This provides a differential speed of 56.6 rpm. If the bowl is rotated at 3000 rpm, the differential of 56.6 rpm is subtracted, yielding a screw speed of 2943.4 rpm. The planetary gear box is thus driven by the bowl. They are joined together and therefore rotate together. Moreover, the shaft 86 will respond in accordance to that ratio. In other words, if it were rotated 53 revolutions, it would make a change of one revolution at the output shaft of the gear box. By appropriate rotation input from the motor 31 to the gear box, the relative speed between the rotated components on the right side of FIG. 4 is changed. In the example just given, the bowl is running at 3000 rpm, and the screw operates at a speed of 2943.4 rpm. As power is applied to the motor 31 and 53 rotations are input, scrolling is slowed by one RPM. In the example just given, the scrolling speed is 56.6 rpm. However, as the motor 31 is operated at a different velocity, there is a change through the gear box between the rotating input and output mechanisms at the right of FIG. 4.

While the foregoing is directed to the preferred embodiment of the present invention, other and further embodiments of the invention may be devised without departing from the basic scope thereof, and the scope thereof is determined by the claims which follow.

What is claimed is:

1. A centrifuge comprising:

a) a horizontal rotatable bowl;

b) an axially positioned rotatable screw with flights there along cooperatively positioned in said bowl to enable solid and liquid separation of a slurry placed in said bowl so that solid and liquid streams are discharged from said bowl;

c) a gear box having a powered input for a gear box drive motor; and connecting between said bowl and said screw to enable:

1) said bowl and said screw to rotate about a common axis in a common direction; and 2) at a speed difference determined by the gear box;

d) a gear box drive motor control system connected to said gear box drive motor for control of said gear box drive motor between specified maximum and minimum speeds to enable said gear box to vary the speed difference between said bowl and screw speeds;

e) wherein said gear box drive motor control system reduces the speed difference between said bowl and said screw speeds to a selected speed difference;

f) wherein said gear box drive motor control system comprises:

1) a variable frequency generator means connected to said drive motor;

2) means for measuring said drive motor operation to monitor operation of said device motor during operation and forming an indication of drive motor operation; and 3) means responsive to said measuring means to change the frequency of said frequency generator means in response to measurements thereby.

2. The apparatus of claim 1 wherein said measuring means measures current to said drive motor to thereby measure torque of said motor.

3. The apparatus of claim 2 wherein frequency is measured by a frequency measuring means, and said frequency generator means is changed to obtain a measured frequency output to said drive motor.

4. The apparatus of claim 1 wherein said bowl and said screw are driven by a main drive motor connecting to said bowl and said screw to enable said main drive motor to provide power for rotation of both said bowl and said screw, and said gear box provides a gear box determined difference in speed of said bowl and said screw in the absence of a gear box drive motor input to said gear box.

5. The apparatus of claim 4 wherein said gear box is constructed and arranged to enable the speed difference between said bowl and said screw to be reduced as low as one revolution per minute.

6. The apparatus of claim 5 wherein said gear box has a pair of concentric inputs to enable connection to said bowl and said screw to be concentrically relatively positioned.

7. The apparatus of claim 6 wherein bowl is supported at spaced ends thereof for rotation;

said screw is supported at spaced ends thereof within said bowl;

said bowl and said screw have concentrically positioned, rotatable ends connected to said concentric inputs of said gear box.

8. The apparatus of claim 7 wherein said bowl and said screw are enclosed in a surrounding housing having solid and liquid output means.

9. The apparatus of claim 8 wherein said bowl includes a liquid containing cylindrical shell defined by upstanding end walls at spaced ends thereof having a liquid draining output means at a relative height with respect to said cylindrical shell to accumulate a head of liquid to said liquid draining output means during rotation, and a slurry supply line connected to deliver a flow of liquid and solid in a slurry into said bowl.

10. The apparatus of claim 9 wherein said shell is constructed with a portion tapering toward the axis of rotation thereof so that said screw and flights thereon force solid material along the tapering portion of said shell toward said solid output means.

11. The apparatus of claim 10 wherein said shell is rotated in said housing, thereby enabling said solid and liquid output means to deliver solid and liquid discharges in said housing for gravity collection.

12. A method of controlling the operation of a horizontal centrifuge to vary the separation of solid and liquid materials from a slurry comprising the steps of:

a) rotating a bowl around a screw with flights where both said bowl and screw rotate in a common direction;

b) connecting said bowl and said screw with a gear box to rotate at a speed difference defining a scrolling rate so that a slurry in said bowl is interacted with said bowl and screw flights to direct separated solid and liquid materials to spaced solid and liquid material output means for discharging solid and liquid material; and c) wherein said gear box has a gear box input connected to a gear box motor to enable operation at a scrolling rate determined by said gear box motor, and including the step of changing gear box motor at least partially in response to gear box torque to reduce the scrolling rate.

13. The method of claim 12 wherein gear box motor speed is controlled by providing a frequency variation to said motor.

14. A centrifuge attachment to enable control of the scrolling rate of a screw positioned in a surrounding bowl wherein the bowl and screw are rotationally connected together by a gear box having an input and the gear box varies the scrolling rate dependent on the input thereto, and wherein a main motor provides power for rotation of the centrifuge to separate one material from another, the attachment comprising:

a) a gear box motor connected to the gear box to vary the scrolling rate between the screw and bowl;

b) motor controller connected to said gear box motor to provide variable control of the gear box motor so that the gear box motor is varied in operation to enable the gear box motor to vary the scrolling rate between the bowl and screw; and c) wherein said gear box drive motor rotates at a speed dependent on a frequency input thereto, and said motor controller provides the variable frequency input so that said controller changes the gear box motor speed.

15. The centrifuge attachment of claim 14 wherein said motor controller varies the frequency of current applied to the motor from the motor controller, and the motor controller thereby controls scrolling rate.

16. A centrifuge comprising:

a) a horizontal rotatable bowl;

b) an axially positioned rotatable screw with flights there along cooperatively positioned in said bowl to enable solid and liquid separation of a slurry placed in said bowl so that solid and liquid streams are discharged from said bowl;

c) a gear box having a powered input for a gear box motor and connecting between said bowl and said screw to enable:

1) said bowl and said screw to rotate about a common axis in a common direction; and 2) at a speed difference determined by the gear box;

d) a gear box drive motor control system for control of said gear box drive motor between specified maximum and minimum speeds to enable said gear box to vary the speed difference between said bowl and screw speeds;

e) wherein said gear box drive motor control system reduces the speed difference between said bowl and said screw speeds to a selected speed difference; and f) wherein said bowl and said screw are driven directly by a main drive motor connecting to said bowl and said screw to enable said main drive motor to provide power for rotation of both said bowl and said screw, and said gear box provides a gear box determined difference in speed of said bowl and said screw in the absence of a gear box drive motor input to said gear box.

17. The apparatus of claim 16 wherein said gear box drive motor control system comprises:

a) a variable frequency generator means connected to said drive motor;

b) means for measuring said drive motor operation to monitor operation of said device motor during operation and forming an indication of drive motor operation; and c) means responsive to said measuring means to change the frequency of said frequency generator means in response to measurements thereby.

18. The apparatus of claim 17 wherein said measuring means measures current to said drive motor to thereby measure torque of said motor.

19. The apparatus of claim 18 wherein frequency is measured by a frequency measuring means, and said frequency generator means is changed to obtain a measured frequency output to said drive motor.

20. The apparatus of claim 16 wherein said gear box is constructed and arranged to enable the speed difference between said bowl and said screw to be reduced as low as one revolution per minute.

21. The apparatus of claim 20 wherein said gear box has a pair of concentric inputs to enable connection to said bowl and said screw to be concentrically relatively positioned.

22. The apparatus of claim 21 wherein bowl is supported at spaced ends thereof for rotation;

said screw is supported at spaced ends thereof within said bowl; and said bowl and said screw have concentrically positioned, rotatable ends connected to said concentric inputs of said gear box.

23. The apparatus of claim 22 wherein said bowl and said screw are enclosed in a surrounding housing having solid and liquid output means.

24. The apparatus of claim 23 wherein said bowl includes a liquid containing cylindrical shell defined by upstanding end walls at spaced ends thereof having a liquid draining output means at a relative height with respect to said cylindrical shell to accumulate a head of liquid to said liquid draining output means during rotation, and a slurry supply line connected to deliver a flow of liquid and solid in a slurry into said bowl.

25. The apparatus of claim 23 wherein said shell is constructed with a portion tapering toward the axis of rotation thereof so that said screw and flights thereon force solid material along the tapering portion of said shell toward said solid output means.

26. The apparatus of claim 25 wherein said shell is rotated in said housing, thereby enabling said solid and liquid output means to deliver solid and liquid discharges in said housing for gravity collection.

* * * * *